US009945229B2

(12) United States Patent
Kern

(10) Patent No.: US 9,945,229 B2
(45) Date of Patent: Apr. 17, 2018

(54) FORMWORK SYSTEM

(71) Applicant: KERN Tunneltechnik SA, Lugano-Paradiso (CH)

(72) Inventor: Annalisa Kern, Lugano-Paradiso (CH)

( * ) Notice: Subject to any disclaimer, the term of this patent is extended or adjusted under 35 U.S.C. 154(b) by 0 days.

(21) Appl. No.: 15/450,799

(22) Filed: Mar. 6, 2017

(65) Prior Publication Data

US 2017/0254202 A1 Sep. 7, 2017

(30) Foreign Application Priority Data

Mar. 7, 2016 (EP) ..... 16158965

(51) Int. Cl.

| | |
|---|---|
| ***E21D 11/00*** | (2006.01) |
| ***E21D 11/40*** | (2006.01) |
| ***E21D 11/10*** | (2006.01) |
| ***E21D 5/04*** | (2006.01) |

(52) U.S. Cl.
CPC ..... *E21D 11/10* (2013.01); *E21D 5/04* (2013.01); *E21D 11/102* (2013.01)

(58) Field of Classification Search
CPC ..... E21D 11/00; E21D 11/40; E21D 11/10; F16L 55/16
USPC ..... 405/132–153; 29/407.01, 407.05, 29/705–707, 709, 714, 897.3; 249/20–22; 425/63–65
See application file for complete search history.

(56) References Cited

U.S. PATENT DOCUMENTS 1,591,907 A * 7/1926 Yager ..... B28B 7/30 249/17
2,213,159 A * 8/1940 Durley ..... E04G 17/00 249/194
2,705,359 A * 4/1955 Strandberg ..... E04G 11/22 249/20
3,252,199 A * 5/1966 Bossner ..... E04L 31/3505 182/128
3,453,707 A * 7/1969 Johansson ..... E04G 11/22 249/20

(Continued)

FOREIGN PATENT DOCUMENTS

DE 3826623 A1 * 2/1990 ..... E21D 11/10
DE 10040777 A1 3/2002

(Continued)

*Primary Examiner* — Benjamin F Fiorello
*Assistant Examiner* — Edwin J Toledo-Duran
(74) *Attorney, Agent, or Firm* — Welsh Flaxman & Gitler LLC

(57) ABSTRACT

A formwork system (10; 60), especially for tunnel construction, includes at least one support arrangement (14) for supporting at least one formwork element (16-26; 72-78). The formwork system further includes at least one concrete pump (36), a plurality of concrete supply units (42) for supply to the formwork element and at least one controller (32). On the formwork element (16-26; 72-78) and/or on the support arrangement (14) at least two pressure sensors (44; 92) are disposed at different vertical positions and are connected to the controller (32) of the formwork system, which pressure sensors (44; 92) are designed to measure the pressure acting upon the formwork elements (16-26; 72-78) at a minimum of two different heights of the formwork element, and that the controller (32) is designed to control the concrete supply units (42) individually, dependent on the signal from the pressure sensors (44; 92).

15 Claims, 5 Drawing Sheets

(56) References Cited

U.S. PATENT DOCUMENTS 3,775,929 A * 12/1973 Roodvoets ..... E04F 21/1838 33/286
3,973,885 A * 8/1976 Schmidt ..... E04G 11/24 249/22
4,040,774 A * 8/1977 Scheller ..... E04G 11/28 249/20
4,126,407 A * 11/1978 Ahlgren ..... E04G 11/28 249/10
4,505,622 A * 3/1985 Asszonyi ..... B21F 27/128 405/146
4,546,425 A * 10/1985 Breitholtz ..... E01C 19/288 366/128
4,621,947 A * 11/1986 Babendererde ..... E21D 11/10 405/146
4,930,935 A * 6/1990 Quenzi ..... E01C 19/006 404/114
4,974,700 A * 12/1990 Gates ..... E04G 11/06 182/128
5,471,391 A * 11/1995 Gudat ..... E01C 19/004 340/995.1
5,846,027 A * 12/1998 Fujii ..... E21D 11/08 405/146
5,942,679 A * 8/1999 Sandstrom ..... E01C 19/26 404/133.05
5,991,687 A * 11/1999 Hale ..... A01B 79/005 342/357.31
6,188,942 B1 * 2/2001 Corcoran ..... E01C 19/006 701/408
6,880,643 B1 * 4/2005 Zimmerman ..... E02F 3/84 172/4.5
7,731,450 B2 * 6/2010 Congdon ..... E01C 19/288 404/84.5
8,332,105 B2 * 12/2012 Laux ..... E01C 19/288 404/133.05
2002/0102136 A1 * 8/2002 Holland ..... B08B 9/049 405/184.1
2003/0047003 A1 * 3/2003 Miyamoto ..... E01C 19/288 73/660
2003/0172739 A1 * 9/2003 Horiuchi ..... G01M 7/025 73/662
2010/0215434 A1 * 8/2010 Wolf ..... E01C 19/288 404/117
2014/0083195 A1 * 3/2014 Olschewski ..... E01C 19/288 73/649
2016/0054283 A1 * 2/2016 Stromsoe ..... E02D 1/02 73/488

FOREIGN PATENT DOCUMENTS

GB 2498524 A 7/2013
JP 2932323 B2 8/1999
JP 2008088696 A 4/2008
JP 2009155819 A 7/2009

* cited by examiner

FORMWORK SYSTEM

BACKGROUND OF THE INVENTION

The present invention relates to a formwork system, especially for tunnel construction. The formwork system includes at least one support arrangement for supporting a formwork having a plurality of formwork elements. The formwork system includes at least one controller for the support of the formwork elements and the concrete supply for the space to be filled with concrete. An example of a generic prior art formwork system is disclosed in U.S. Pat. No. 2,626,509.

SUMMARY OF THE INVENTION

It is an object of the invention to improve the current generic formwork system so that allowances can be made for individual circumstances in the construction of a concrete wall, in particular of a concrete crown.

According to the invention, at least two pressure sensors are disposed vertically at different positions on the formwork element and/or on the support arrangement and connected to the controller of the formwork system. The pressure sensors are designed to measure the pressure acting upon the formwork elements due to the concrete poured into the formwork at a minimum of two different heights of the formwork element. The controller is designed to control the concrete supply units individually dependent on the signal from the pressure sensors. In this way it is possible to measure the concrete pressure acting at different points on the formwork element (or preferably plurality of formwork elements) and the controller can compare the pressure values measured by the pressure sensors with set values and control the concrete supply so that the concrete pressure at the different points of the formwork elements conforms to the set values. In this way a concrete wall, in particular a concrete crown, can be produced with specified homogeneous material properties throughout the entire wall or crown area.

In a preferred embodiment of the invention, the support arrangement has at least one hydraulic support beam for supporting the formwork element and the controller is designed to control the force of the support beam dependent on the pressure measured in the pressure sensors. The pressure can therefore be regulated not only through the individual concrete supply unit, but also through the support pressure by means of the support beams. Moreover, the pressure sensors do not have to be provided in the formwork itself, but can be disposed on the force absorption elements of the formwork elements, for example at the points at which the support structure statically supports the formwork element. In particular, if the entire formwork includes a plurality of formwork elements, which is normal in tunnel construction, one is able to exactly measure the pressure acting on the single formwork elements at the support points of the formwork elements and to control or regulate the concrete supply units and/or the support force of the hydraulic support beams accordingly.

In a technically simplified embodiment, the pressure sensor is disposed at the connecting point between the support beam and the formwork element and/or the support arrangement. Such an arrangement is easy to implement, for example by means of force sensors that are known in the art.

Preferably, a plurality of pressure sensors is disposed two-dimensionally distributed over the formwork element. Preferably the pressure sensors are disposed evenly over the entire surface of the wall and therefore over the surface of the formwork elements, if multiple sensors are used. In this way it is possible to detect a very good pressure distribution of the concrete on the formwork and to adjust the pressure, if necessary.

Preferably, the formwork system contains at least one vibration device and the controller is designed to control the vibration device dependent on the pressure measured in the pressure sensors. In this way, it is possible to increase the concrete pressure by means of additional vibration in areas where the concrete pressure acting on the formwork is too low. The vibration device can be disposed, for example, in combination with the formwork elements. However, external vibrators can also be provided in combination with the concrete supply units, which affect the viscosity of the supplied concrete.

Preferably, a plurality of vibration devices is disposed at different positions on the formwork element and the controller is designed to control the vibration device individually dependent on the signals from the pressure sensors. In this way it is possible to achieve a specified pressure profile of the concrete on the formwork elements, producing desired homogeneous strength properties over the surface of the concrete wall. Preferably, the vibration devices are disposed evenly distributed over the formwork elements. In this way, it is possible to achieve an even compaction across the surface of the formwork.

In a preferred further embodiment of the invention, the controller is designed to control the concrete pump dependent on signals from the pressure sensors. Different concrete pumps can be provided for different concrete supply units, for example, and the pressure acting on the formwork element can be influenced through the pumping pressure of the concrete pump.

Preferably, the at least one concrete pump is connected by means of at least one distribution device to a plurality of concrete supply units. In this case, the controller is designed to control the distribution device dependent on the signals from the pressure sensors, in order to achieve a homogeneous, specified pressure profile and therefore desired material properties of the concrete wall produced.

Preferably, the controller has a display for displaying the formwork elements and the pressure values measured there. In this way an operator can see the pressure values that were recorded at different parts of the formwork elements and can immediately determine whether the concrete has been supplied in the specified manner to the space behind the formwork elements. This is extremely important when constructing a tunnel crown, for example, since it must be ensured that the concrete fills the space completely between a tunnel wall and the formwork elements at all points beyond the formwork elements and is therefore able to meet the required strength properties of the tunnel crown.

In a preferred embodiment of the formwork system, according to the invention, this formwork system has at least four formwork elements, which are supported against the support arrangement by at least four support beams. Such an arrangement is therefore appropriate for a tunnel crown, the four formwork elements more or less forming the upper semicircle of the tunnel crown. Preferably, the four formwork elements are arched and form a crown surface for a tunnel crown.

Since a tunnel formwork is generally very long, the formwork system according to the invention preferably has a plurality of consecutive, horizontally disposed support arrangements with their own formwork elements. The controller is then designed to individually control the pressure applied to the formwork elements of the single support arrangements dependent on the pressure values from the pressure sensors. In this way it is possible to produce a homogeneous tunnel formwork over an extended length in one process, in which very good homogeneity of the concrete wall is achieved over the surface.

In a method according to the invention, that uses the formwork system according to the invention, a concrete wall is erected in which the pressure acting on the formwork element is measured by means of pressure sensors at different points and the at least one concrete pump and/or the concrete supply unit is/are controlled dependent on the signals from the pressure sensors. In this way it is possible through individual control of the concrete supply unit and/or of the concrete pump(s) to ensure that an even pressure profile or a specified pressure profile is achieved over the surface of the formwork elements, which results in tunnel crowns with the required strength properties.

The signals from the pressure sensors can also be used to control vibration devices or distribution devices between the concrete supply units in order to fill the concrete supply unit to the individual locations between a tunnel wall and the formwork elements as evenly and homogeneously as possible.

In addition to the signals from the pressure sensors, the signals of other sensors, such as temperature sensors, optical sensors or chemical sensors, can also be used to control the support arrangement, the individual concrete supply units and the vibration devices.

With the invention, it is therefore possible to determine and analyze the properties of the concrete poured into the formwork and to use this information for control of the concrete supply units, the support arrangement and the vibration devices. For better operation the controller preferably has a display, which displays the formwork system two-dimensionally, as well as a concrete filling display for the different areas of the formwork elements. The measured forces are preferably analyzed by a software and displayed both digitally and visually. Preferably, the controller has an interface for controlling additional components, such as a vibration device, and also for transfer of the data to external data carriers or to an additional PC. On the basis of the measured signals from the pressure sensors, the compaction can be controlled automatically beyond the formwork elements.

The invention provides a countercheck for the static calculation of the formwork process. This substantially increases the safety of the formwork system and of the persons who operate the formwork system. The tunnel walls that are produced are better and more homogeneous, which optimizes the concrete pouring processes. With the invention, concrete walls and crowns are produced in conformity with standards. The controller outputs can also be used for safety systems, if excess voltages or excess pressures need to be determined at individual locations of the formwork elements. The invention contributes to the quality assurance of the structure.

An essential aspect of the invention is that, by means of selective control of the concrete pump and/or of the concrete supply unit and/or of the at least one vibration device, the concrete compaction processes can be controlled selectively and individually, in order to achieve desired material properties of the completed concrete wall and/or of the completed concrete crown.

It is apparent to those skilled in the art, that the single components of the invention can be provided singly or severally and that they can also be embodied as an integrated unit or distributed at a plurality of locations. The controller can comprise a plurality of computers, which is distributed over the length of the tunnel. A tunnel formwork system likewise normally comprises a plurality of formwork elements, e.g. four formwork elements distributed over the crown sector and three to six support arrangements in succession with four formwork elements, respectively, so that the overall system preferably comprises between ten and fifty formwork elements.

The following terms are used synonymously: vibration device—vibrator; pressure sensing device—pressure sensor; temperature sensing device—temperature sensor.

BRIEF DESCRIPTION OF THE DRAWINGS

The invention is described in the following based on examples with reference to the schematic drawings, which show the following.

DETAILED DESCRIPTION OF THE INVENTION

Figure 1:
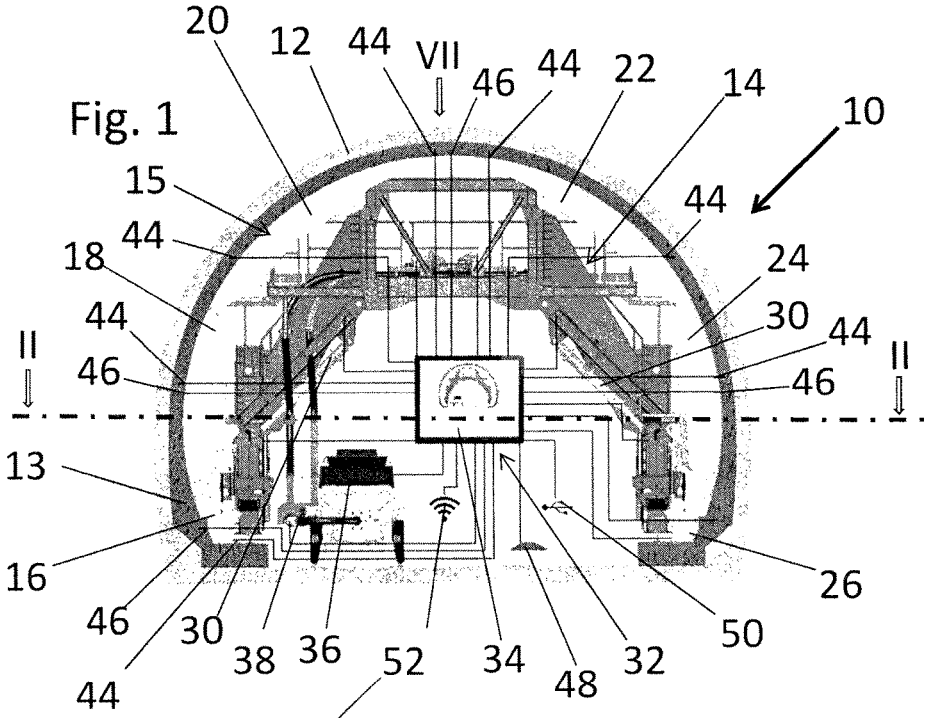
FIG. 1 is a front view of the tunnel formwork system according to the invention.
Figure 2:
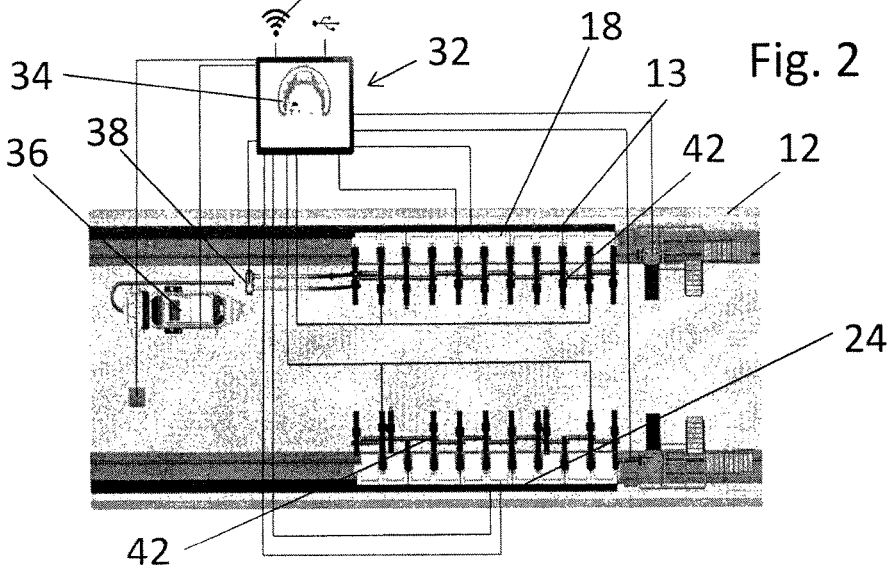
FIG. 2 is a cross section II-II from FIG. 1.

FIG. 1 shows a tunnel formwork system 10, according to the invention, that is located within an opened up tunnel crown 12. The tunnel formwork system 10 according to the invention is made up of a support arrangement 14 for supporting a formwork 15, which includes mutually pin-connected formwork elements 16-26, whose outer side is slightly arched and is oriented to the tunnel crown 12. Between the outer side of the formwork elements 16-26 and the tunnel crown or tunnel wall 12 an empty space 28 is formed, which is filled with concrete 13. The support arrangement 14 contains hydraulic support beams 30 to support the formwork elements 16-26 with a specified pressure against the poured concrete 13. The formwork system 10, according to the invention, is controlled by a central controller 32, which preferably has a monitor 34 for depicting the formwork system and the corresponding measured values. The formwork system 10 further includes a concrete pump 36 with a distribution device 38 and concrete pipes 40, which lead to the single concrete supply units 42, which are depicted in more detail in FIGS. 2 and 5. The central controller 32 is connected to pressure sensors 44, and also to temperature sensors or ultrasonic sensors 46, which measure both the pressure acting on the formwork elements 16-26 due to the poured concrete and the temperature of the concrete, in order to provide information to the central controller 32, both about the density and fill level of the concrete in the space between the outer side of the formwork elements 16-26 and the tunnel wall 12 and also about the chemical reaction during setting of the concrete, which chemical reaction is accompanied by heat generation or a change in the density. By measuring the temperature or the density it is therefore possible to determine with accuracy the progress of the setting reaction. For this purpose the controller is optionally connected to a concrete analysis device 48, which for example analyzes the setting behavior of a concrete sample and also possibly of its strength, in order to draw inferences about the strength of the concrete between the formwork elements 16-26 and the tunnel wall.

The controller 32 is of course connected to the concrete pump 36 and also to the distribution device 38. Further, the controller preferably has a USB interface 50, and a wireless interface 52, such as Wi-Fi® or Bluetooth®.

Due to the measurement of the temperature, density and pressure conditions depicted in FIG. 1 it is possible for the formwork system to control the single concrete supply units 42 and/or the hydraulic supports 30 so that the concrete flows and is compacted in a desired manner and also in accordance with the specified pressure conditions, in order to ensure the desired quality of the concrete formwork.

Figure 3:
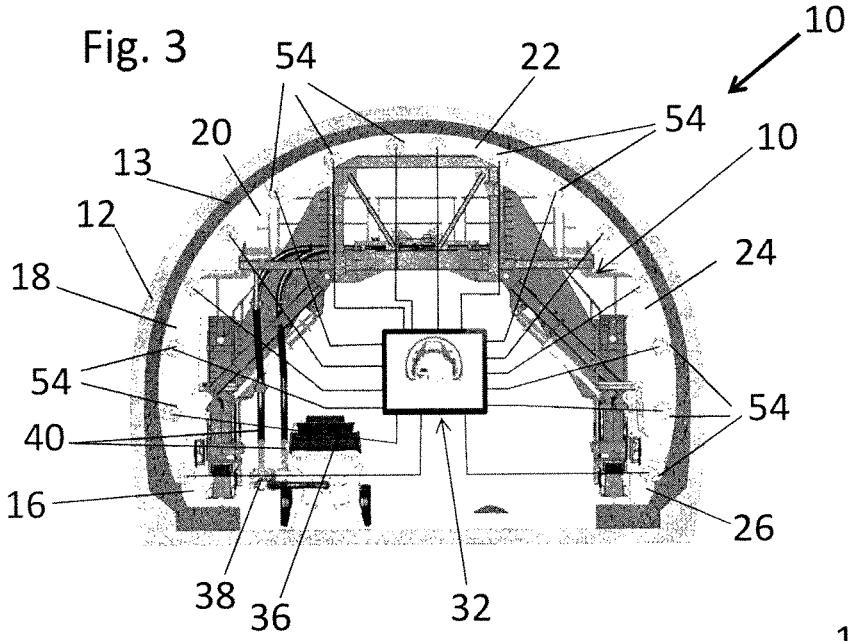
FIG. 3 is a view according to FIG. 1 with a controller of vibration devices.

FIG. 3 likewise shows the formwork system 10 of FIG. 1, here depicting the connection of the central controller 32 to the vibrators 54. The central controller 32 can individually control the single vibrators 54 dependent on the sensor values, in order to achieve selective compacting of the concrete in different areas of the tunnel wall 12, therefore ensuring a concrete quality with the highest possible homogeneity over the entire tunnel wall 12.

Figure 4:
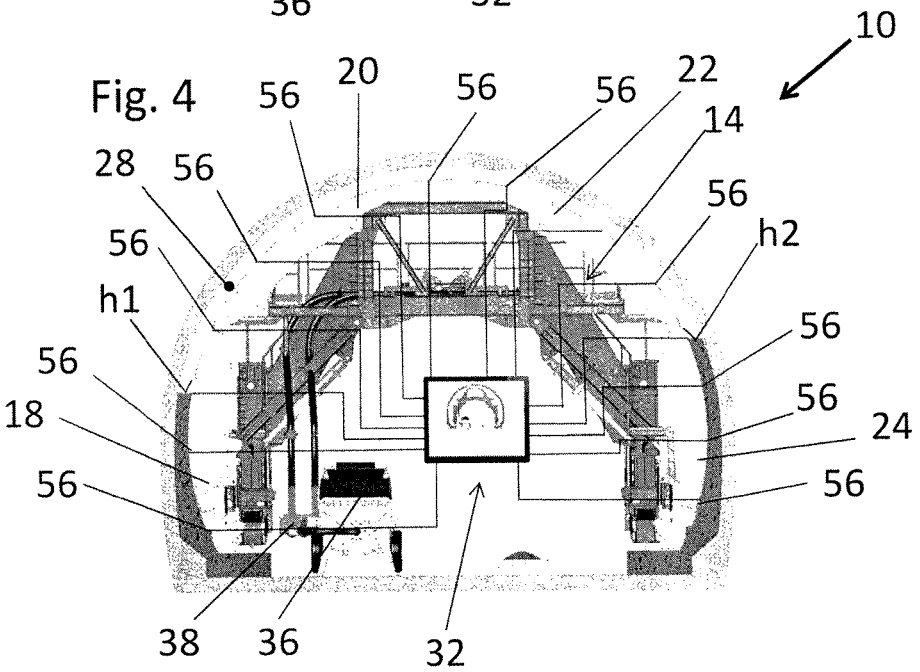
FIG. 4 is a view according to FIG. 1 with a differential level controller.

FIG. 4 shows the connection of the central controller 32 with differential level sensors 56, which for example can be pressure sensors, optical sensors, thermal sensors, ultrasonic sensors or chemical sensors. These differential level sensors 56 are distributed evenly over the outer side of the formwork elements 16-26. In this way it is easily possible to measure a different fill height h1, h2 of the concrete 13 on both sides of the tunnel wall and, through individual control of the concrete supply units 42 and vibrators 54, to ensure that the fill level is even and regular on both sides.

Figure 5:
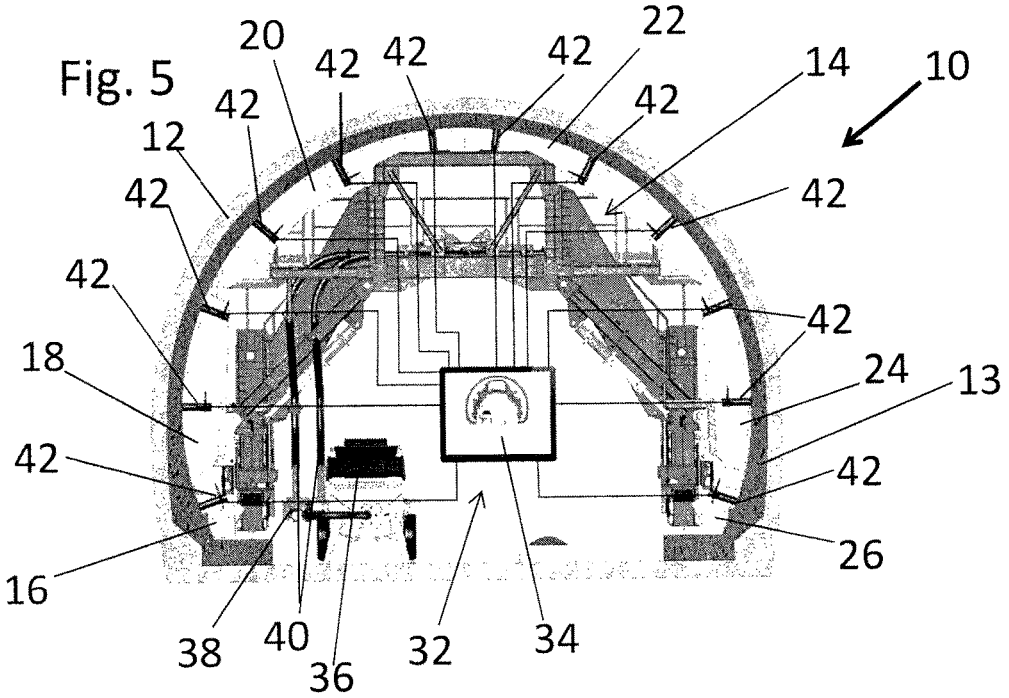
FIG. 5 is a view according to FIG. 1 with an individual controller of concrete supply units.

FIG. 5 shows the connection of the central controller 32 to the single concrete supply units 42. Through control of the concrete pump 36 and of the distribution device 38 and other distribution elements not depicted, such as shut-off valves, it is possible to supply the concrete selectively to the single concrete supply units 42 in order to achieve a homogeneous concrete supply. Ideally the concrete is supplied via the relatively evenly distributed concrete supply units 42 in combination with corresponding actuation of the vibration devices 54 of FIG. 3.

Figure 6:
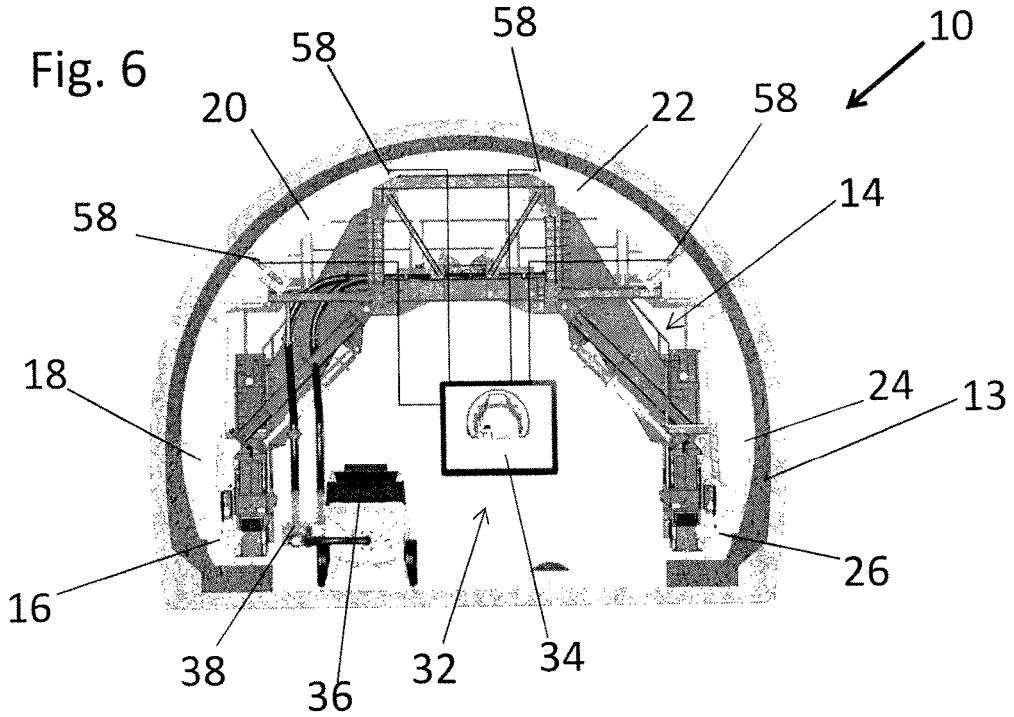
FIG. 6 is a controller according to FIG. 1 with central detection and analysis of pressure sensors.

FIG. 6 shows the connection of the central controller 32 to pressure sensors 58, which extend evenly over the upper section of the tunnel formwork, i.e. over the upper formwork elements 20-24, so that due to this arrangement of pressure sensors 58 it can be verified whether the concrete 13 between the tunnel wall 12 and the outer side of the formwork elements 16-26 is in fact completely filled, which finds expression in corresponding pressure values. These pressure sensors can also be embodied as hydraulic cylinders, which deliver controllable support pressure for the formwork elements. These pressure sensors 58 can therefore also be used for pressure control of the support pressure of the formwork elements 20 to 24.

Figure 7:
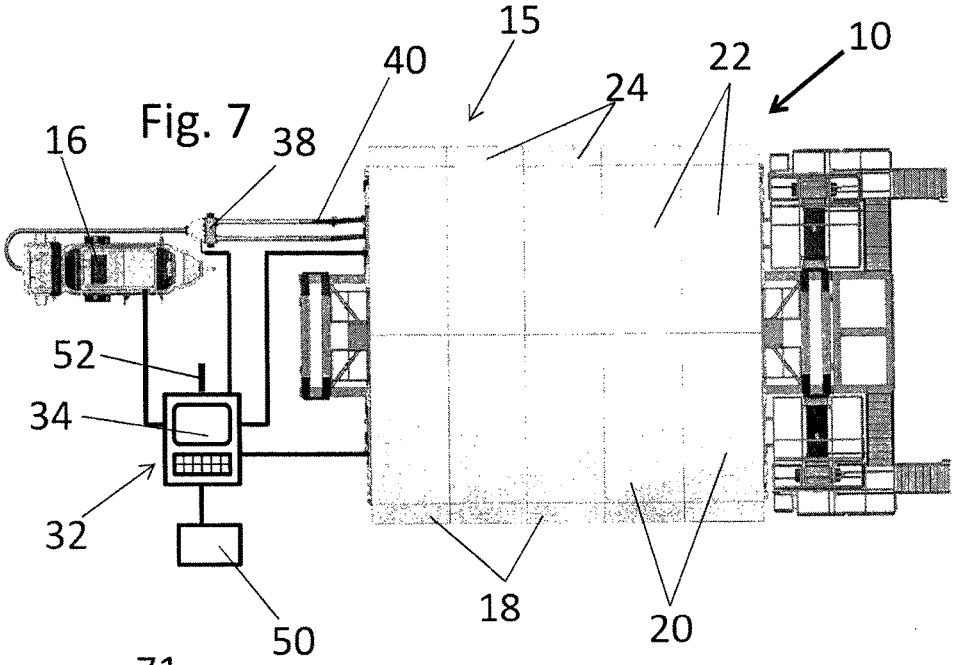
FIG. 7 is a view VII from FIG. 1.

Finally, FIG. 7 shows a top view of the formwork system according to the invention as shown in FIG. 1-6, however in an isolated view, i.e. not in operating position in a tunnel crown 12.

Figure 8:
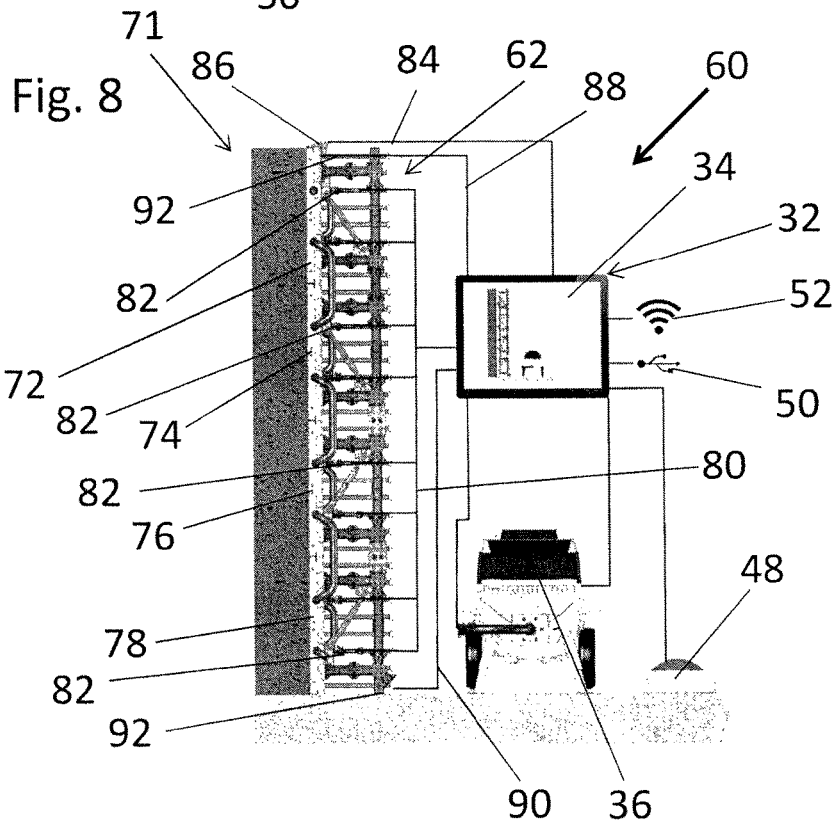
FIG. 8 is a front view of a second embodiment of a formwork system according to the invention for the manufacture of flat walls.

FIG. 8 shows a formwork system 60 for producing straight walls. The formwork system 60 comprises a support arrangement 62, a central controller 32 with a display 34, a concrete pump 36, possibly a distribution device, which is not depicted, optionally a concrete analysis device 48 and a plurality of flat formwork elements 72-78, which are disposed one above the other and side by side in order to form a wall of the desired size. The controller is connected by means of a first control line 80 to concrete supply units 82. By means of a second control line 84 the controller 32 is connected to a temperature sensor or ultrasonic sensor 86. By means of a third control line 88 and a fourth control line 90 the controller 32 is connected to pressure sensors 92. In this way the central controller 32 measures the pressure conditions and also the temperature conditions on the side of the formwork 71 facing the concrete 13, which side consists of the single formwork elements 72-78.

Figure 9:
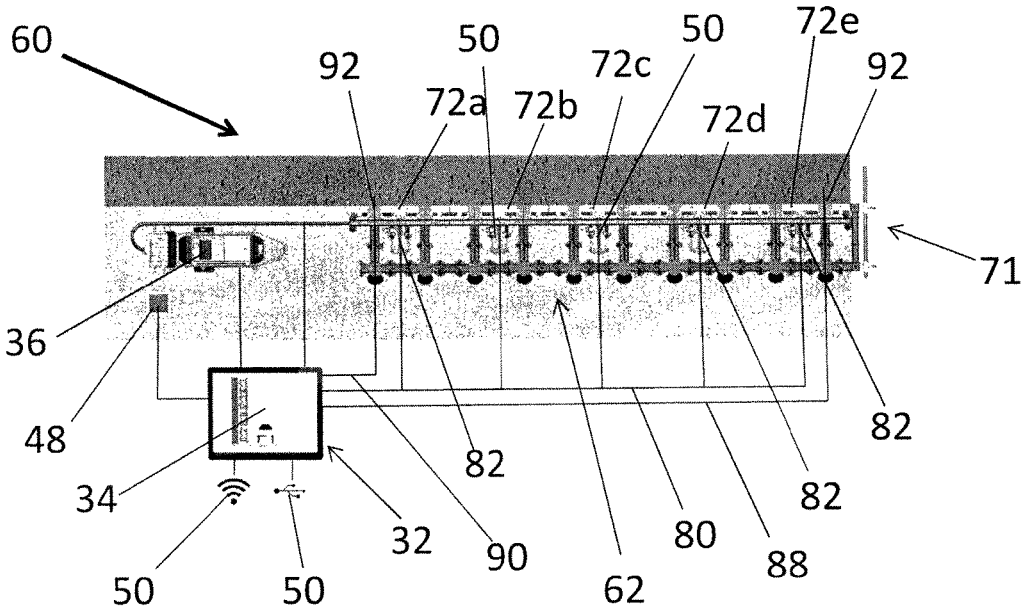
FIG. 9 is a view from above of the formwork system according to FIG. 8.

FIG. 9 shows the formwork system 60 of FIG. 8 in top view. It should be noted that identical or functionally equivalent elements are designated in the figures with identical reference marks.

The invention can deviate from the depicted embodiment, which therefore should not be understood as limiting the subject matter of the invention. The invention can be varied as desired within the scope of protection of the following claims.

REFERENCE LIST

10 tunnel formwork system
12 tunnel wall—tunnel crown
13 concrete layer
14 support arrangement
15 formwork
16-26 formwork elements
28 empty space
30 support cylinder/support beam
32 central controller
34 display
36 concrete pump
38 distribution device
40 concrete pipes
42 concrete supply units for supply to the formwork
44 pressure sensors
46 temperature sensor/ultrasonic sensors
48 concrete analysis device
50 USB or other interface
52 Wi-Fi or WLAN transmitter
54 vibrator
56 sensors
58 pressure sensors
60 formwork system for flat walls
71 flat formwork
80 first control line
82 concrete supply unit
84 second control line
86 temperature sensor/ultrasonic sensor
88 third control line
90 fourth control line
92 pressure sensor

What is claimed is:

1. A formwork system for tunnel construction, comprising: at least one support arrangement for supporting at least one formwork element, the formwork system further comprising at least one concrete pump, a plurality of concrete feeders to the at least one formwork element and at least one control unit, at least two pressure sensors arranged at vertically different positions on the at least one formwork element or on the support arrangement to measure a pressure acting on the at least one formwork element at at least two different heights of the formwork element, the at least one control unit is connected to a control unit of the formwork system and controls the concrete feeders individually as a function of a signal of the at least two pressure sensors, and wherein the at least one support arrangement has at least one hydraulic support beam for supporting the at least one formwork element, the control unit also directly controls support pressure on the at least one hydraulic support beam as a function of pressure values measured with the at least two pressure sensors, and wherein the at least one control unit is connected to at least one vibrator, the at least one vibrator being integrated into the at least one formwork element and the control unit can individually control a single vibrator dependent on values of the at least two pressure sensors in order to achieve selective compacting of poured concrete in different areas of a tunnel wall, the tunnel wall being directly connected to the at least one formwork element by the poured concrete filling an empty space between the at least one formwork element and the tunnel wall, thereby ensuring a concrete quality of the poured concrete filling the empty space with a highest possible homogeneity over the tunnel wall, wherein the at least one support arrangement contains the at least one hydraulic support beam to support the formwork elements with a specified pressure against the poured concrete.

2. The formwork system according to claim 1, wherein the at least two pressure sensors are arranged at connecting points between the at least one support beam and the at least one formwork element.

3. The formwork system according to claim 1, wherein the at least two pressure sensors are arranged distributed over the at least one formwork element.

4. The formwork system according to claim 1, wherein the at least two pressure sensors are arranged between the at least one formwork element and the at least one hydraulic support beam.

5. The formwork system according to claim 1, further comprising a shuttering system, including a plurality of jogging devices arranged at different points of a shuttering element, and the control unit controls the jogging devices individually as a function of signals of the at least two pressure sensors.

6. The formwork system according to claim 1, wherein the at least one vibrating device is arranged in a concrete feed.

7. The formwork system as claimed in claim 1, wherein the control unit controls a concrete pump as a function of signals of the at least two pressure sensors.

8. The formwork system according to claim 7, wherein the concrete pump is connected to the concrete feeders via at least one distributor device output means in response to the signals from the at least two pressure sensors.

9. The formwork system as claimed in claim 1, wherein the control unit has a screen for displaying the formwork elements and the pressure values measured there.

10. The formwork system as claimed in claim 1, wherein the formwork system has at least four formwork elements, which are supported against the support arrangement by at least four supporting cylinders.

11. The formwork system according to claim 10, wherein the at least four formwork elements are curved and form a formwork for a tunnel vault.

12. The formwork system according to claim 1, further comprising a plurality of support arrangements, arranged horizontally one behind the other, with their own formwork elements, and that the control unit controls a pressurization of the formwork elements of the plurality of individual support arrangements as a function of the pressure values of the at least two pressure sensors.

13. A method for building a concrete wall with the formwork system according to claim 1, comprising the steps of:

applying pressure on the at least one formwork element;

controlling the at least two pressure sensors; and controlling at least one concrete pump and the concrete feeders as a function of the signals of the at least two pressure sensors.

14. The method according to claim 13, whereby at least one vibrating device is controlled as a function of the signals of the at least two pressure sensors.

15. The method according to claim 13, whereby at least one distributor device is controlled between the concrete feeds as a function of the signals of the at least two pressure sensors.

* * * * *